United States Patent [19]

Pöll

[11] Patent Number: 4,936,116

[45] Date of Patent: Jun. 26, 1990

[54] GEM COMPOUND

[75] Inventor: Martin Pöll, Fritzens, Austria

[73] Assignee: D. Swarovski & Co., Wattens, Austria

[21] Appl. No.: 365,308

[22] Filed: Jun. 13, 1989

[30] Foreign Application Priority Data

Jun. 14, 1988 [DE] Fed. Rep. of Germany ..... 3820250

[51] Int. Cl.[5] ..... A44C 17/02

[52] U.S. Cl. ..... 63/28; 63/26; 428/347

[58] Field of Search ..... 63/2, 26, 28, 29.1, 63/32; 428/347, 354, 40, 67

[56] References Cited

U.S. PATENT DOCUMENTS

| | | | |
|---|---|---|---|
| 3,578,550 | 5/1971 | Hoerner et al. | 428/40 |
| 3,931,719 | 1/1976 | Schwab | 63/2 X |
| 3,936,567 | 2/1976 | Veseley | 428/40 X |
| 4,323,611 | 4/1982 | Pöll | 63/28 X |
| 4,353,765 | 10/1982 | Covi et al. | 63/28 X |
| 4,415,623 | 11/1983 | Schlaepfer | 428/347 X |

FOREIGN PATENT DOCUMENTS

| | | | |
|---|---|---|---|
| 297380 | 3/1972 | Austria . | |
| 338020 | 10/1977 | Austria . | |
| 1079872 | 4/1960 | Fed. Rep. of Germany . | |
| 649697 | 6/1985 | Switzerland | 63/26 |

*Primary Examiner*—James R. Brittain

*Attorney, Agent, or Firm*—Neuman, Williams Anderson & Olson

[57] ABSTRACT

The invention relates to a gem compound comprising a plurality of gems bearing a melt adhesive layer, wherein the gems bear on their setting side a first melt adhesive layer, therebelow a filling layer which fills the spaces between the individual gems, and therebelow a second melt adhesive layer which is substantially flat and welded to the first melt adhesive layer in the area of the tips of the gems.

7 Claims, 6 Drawing Sheets

GEM COMPOUND

BACKGROUND OF THE INVENTION

The present invention relates to a gem compound or gem-containing article.

A gem compound is already knoWn in which a plurality of gems are joined together by a melt adhesive layer which covers the setting side of the gems (Austrian patent no. 33 80 20). The disadvantage of these known gem compounds is that when they are applied to a flat unyielding surface of a substrate, the melt adhesive layer communicates with the substrate surface only on the bottom tips of the gems, so that poor adhesion is obtained.

For some purposes a melt adhesive layer is unfavorable since the activating temperature is too high and the material to be provided with the gem compound is damaged. This is the case, for example, with sensitive textile materials and with spun type cast or plastic jewelry.

The invention is based on the problem of providing a gem compound which can be applied in a simple manner to a substrate without damaging the latter, sufficient adhesion being ensured between the gem compound and the substrate.

The invention is based on the finding that this problem can be solved if the bonding surface of the gem compound is of substantially flat design.

The subject of the invention is a gem compound comprising a plurality of gems bearing a melt adhesive layer, which is characterized in that the gems bear on their setting side a first melt adhesive layer, therebelow a filling layer which fills the spaces between the individual gems, and therebelow a second melt adhesive layer which is substantially flat and welded to the first melt adhesive layer in the area of the tips of the gems.

The inventive gem compound is characterized in that the bonding surface formed by the second melt adhesive layer is substantially flat. Thus, when the gem compound is placed on a substrate and the melt adhesive layer activated, an optimal adhesive strength can be obtained because adhesion takes place over the entire surface.

A very essential advantage of the inventive gem compound is the fact that it is readily deformable and thus can be easily adapted to all kinds of surfaces. This is due to the fact that all layers of the compound are readily deformable or bendable.

An effect layer is preferably disposed betWeen the first melt adhesive layer and the filling layer to give the spaces between the individual gems a desired, for example a shiny silver, appearance.

Particular advantages are offered by the inventive gem compound in those cases in which the activation of a melt adhesive layer would damage the material of the substrate. In such a case the bond with the substrate is not obtained via the melt adhesive layer but via a self-adhesive layer or another adhesive layer already applied to the gem compound or subsequently applied thereto. According to a preferred embodiment, a self-adhesive layer is therefore disposed on the second melt adhesive layer.

The first melt adhesive layer, which surrounds the setting side of the gems like a mounting, can be discontinuous, i.e. the individual gems are not connected by a melt adhesive sheet but only bear a kind of mounting consisting of a melt adhesive layer. However, it may also be continuous. This first melt adhesive layer is preferably transparent.

The filling layer preferably consists of a readily deformable material, such as a foamed material, and is preferably provided on both sides with a self-adhesive layer. The thickness of the filling layer preferably corresponds approximately to the height of the mounting portion of the gems.

The self-adhesive layer used may be any known self-adhesive layer. The self-adhesive layer is preferably applied in the form of an intermediate layer bearing a self-adhesive layer on each side.

The gems used may be in particular cut glass gems, preferably crystal glass chatons.

During production of the gem compound the individual layers can be applied singly, but they are preferably applied, except for the first melt adhesive layer, in the form of a prefabricated compound layer preferably comprising an effect layer, a filling layer with self-adhesive layers on both sides and a melt adhesive layer and optionally a self-adhesive layer and optionally a cover layer.

The gem compound of the present invention can be produced by providing a plurality of gems on their mounting side with a first melt adhesive layer, applying a filling layer thereto to fill the spaces between the individual gems and a second melt adhesive layer, and welding the two melt adhesive layers in the area of the tips of the gems on the mounting side. One can then apply a self-adhesive layer to the second melt adhesive layer. One can apply to the gems provided with a melt adhesive layer a prefabricated compound layer comprising an effect layer, filling layer with self-adhesive layer on both sides and a melt adhesive layer and optionally a self-adhesive layer and optionally a cover layer.

The invention shall be explained in more detail in the following With, reference to the draWings which show exemplary embodiments.

DESCRIPTION OF THE PREFERRED EMBODIMENTS

Figure 1:
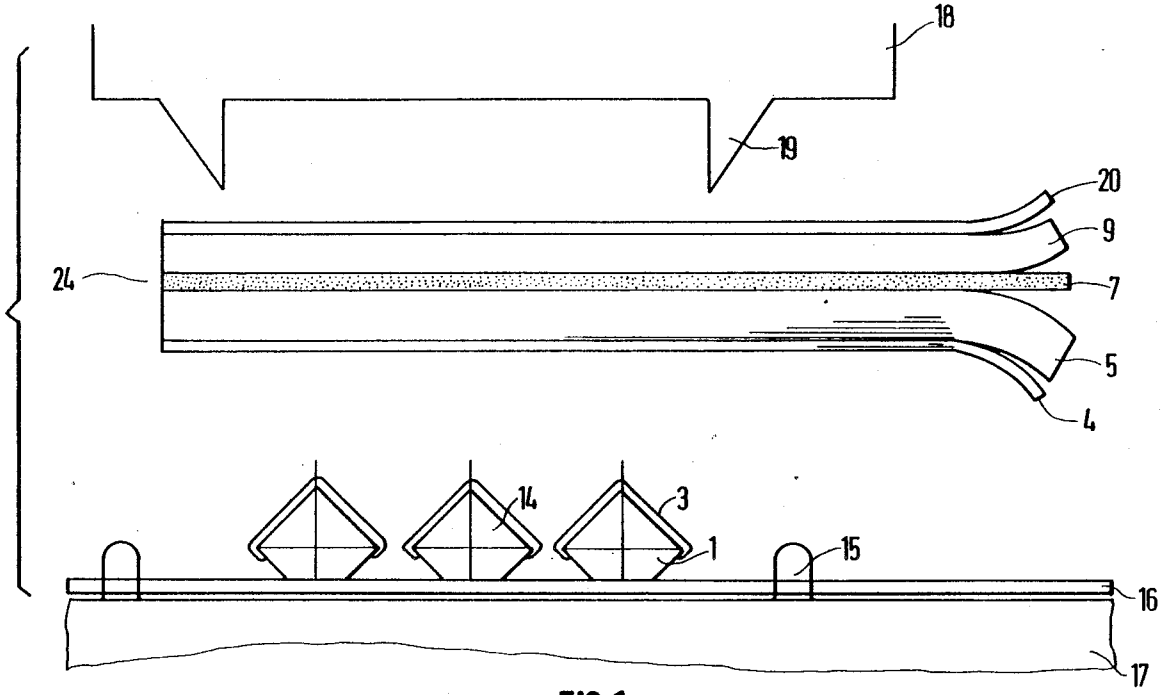
FIG. 1 shows a schematic view of gems and a multilayer compound sheet in a pressing tool before being pressed into a gem compound.

It will be noted from the drawing that FIG. 1 shows that a plurality of gems 1 are present in a selected arrangement on a transfer sheet 16.

The arrangement of the gems existing in the finished gem compound can be selected at will: the gems can be disposed over the full surface with minimum spaces therebetween. Ornamental arrangements of any design are also possible.

Transfer sheet 16 may be any suitable system. Transfer sheet 16 preferably consists of a plastic sheet with a self-adhesive layer.

Gems 1 on transfer sheet 16 are shown in their position on pressing table 17. Their exact position is defined with the help of locating pins 15.

Above gems 1 one can see a compound sheet 24. This sheet consists of the following layers, regarded from the gems toward the top: an effect layer 4, a filling layer 5, a second melt adhesive layer 7, a self-adhesive layer 9 and a cover layer 20.

Above compound sheet 24 one can see pressing head 18 with cutting knives 19.

The gems are preferably cut glass gems, in particular crystal glass chatons.

The melt adhesive layers can be made of any suitable plastics activated by heat, in particular polyamides, polyester resins, epoxy resins, isocyanates and amino resins. The thickness of the melt adhesive layer is usually in the range of 20 to 100 μm.

Figure 3:
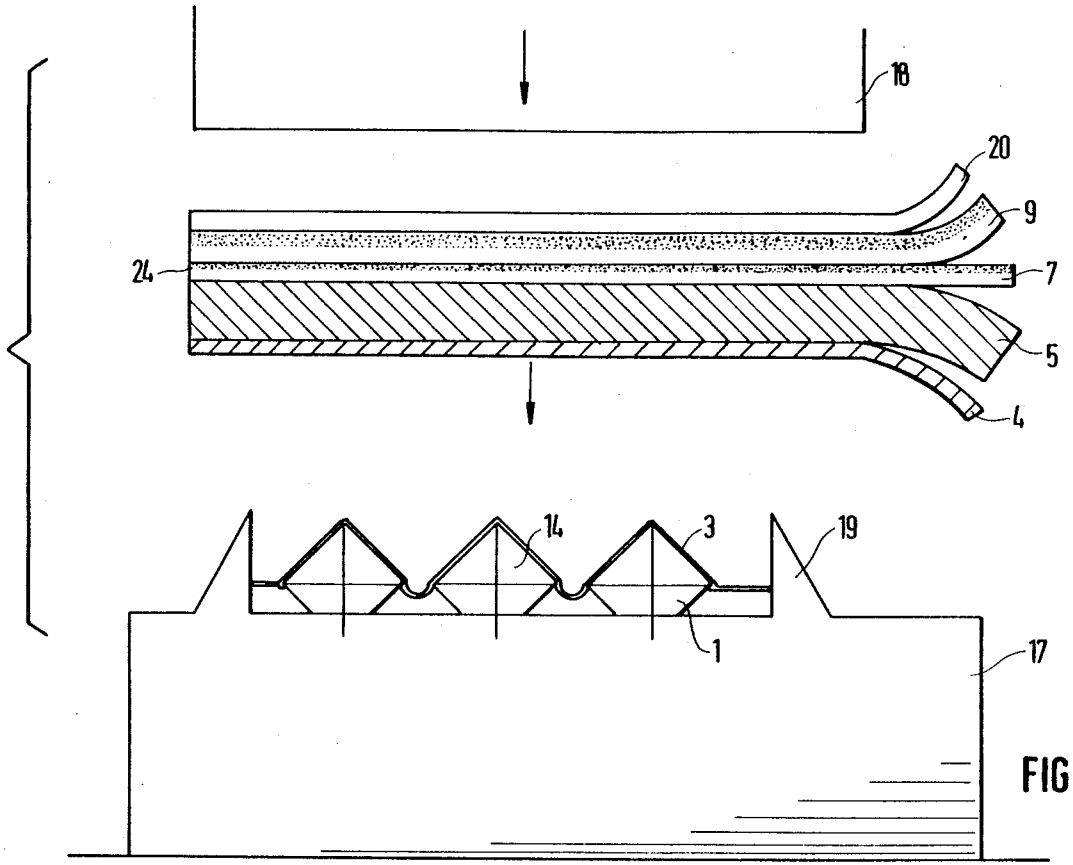
FIG. 3 shows a schematic view of gems and a compound sheet in a pressing tool before being pressed into a gem compound.

First melt adhesive layer 3 covers gems 1 in their mounting portion 14. The melt adhesive layer preferably extends over the equator of gems 1, so as to ensure not only adhesion but also a more stable bond between gem 1 and melt adhesive layer 3 due to the gem being clasped. Melt adhesive layer 3 may be of discontinuous formation, whereby setting side 2 of gems 1 is surrounded with caps of melt adhesive. These are shown in FIG. 1. Alternatively, gems 1 are embraced by a continuous melt adhesive layer 3 as shown in FIG. 3, whereby a melt adhesive layer is also present between the gems.

The melt adhesive layer is preferably colorless and transparent.

An effect layer 4 is applied to the first melt adhesive layer. The effect layer has the purpose of giving the spaces between gems 1 a preferred optical appearance when regarded from the top, i.e. in particular to cover the dark or unattractive layers therebelow. Such an effect layer can be dispensed with if the optical appearance of the other layer is satisfactory or this aspect is of minor importance for the desired application.

Effect layer 4 may be in particular metal foil, such as gold foil or aluminum foil, or vaporized polyester sheet having a metallic effect or colored plastic sheet.

The thickness of the effect sheet is in particular within the range of 5 to 30 μm.

These small thicknesses guarantee that the sheet tears in the area of tips 8 of gems 1 during production of the gem compound, and exists in the finished gem compound substantially only in the area between gems 1 and adjacent thereto on the gems. Effect sheet 4 is pressed into this position by filling layer 5 during production of the gem compound.

Filling layer 5 preferably consists of a readily compressible material, in particular a foamed material. Particularly suitable is foamed Moltoprem, as is commercially available in the form of assembly belts. Such assembly belts have a self-adhesive layer on both sides. The use of a filling layer with a self-adhesive layer on each side is advantageous since the layers to be applied can in this case be prefabricated into a compound sheet in a simple manner. The adhesion between the filling layer and the adjacent layers is also improved.

Filling layer 5 serves, on the one hand, to bring effect layer 4 in the right position, and also to provide a continuous plane by filling in substantially the entire space 6 between gems 1 so that second melt adhesive layer 7 comes to lie substantially flat. This is essential since the flat arrangement makes the entire surface of the gem compound available for bonding and thereby ensures an optimal bond with substrates made of materials that are poorly deformable.

The thickness of filling layer 5 depends on the size of gems 1. The thickness should preferably correspond approximately to the height of mounting portion 14 of gems 1. According to a preferred embodiment, a self-adhesive layer 9 is provided on second melt adhesive layer 7.

The self-adhesive layer can exist, for example, in the form of an intermediate layer which bears self-adhesive on both sides. The self-adhesive layer can be applied subsequently to the second melt adhesive layer or the substrate. If a self-adhesive layer is present, a cover layer 20 is preferably provided which may be made of paper or plastic, preferably silicon-coated paper.

If an intermediate layer is used, it is preferably made of the same material as filling layer 5, i.e. preferably a layer of foamed material with a self-adhesive layer on each side.

According to a preferred embodiment, the gem compounds are produced in a press. Compound sheet 24 or individual desired layers are pressed by means of pressing head 18 under elevated pressure, for example 2 to 3 bar pressure above atmospheric, onto gems 1 disposed on pressing table 17.

During the pressing process, ultrasonic radiation is preferably also used. The ultrasonics effects an activation of the polymers in the melt adhesive layers which are Welded together. The welding occurs substantially only in the area of tip 8 of gems 1. Due to the bond of first melt adhesive layer 3 with second melt adhesive layer 7, one obtains a stable gem compound with firm adhesion of gems 1 therein.

Figure 2:
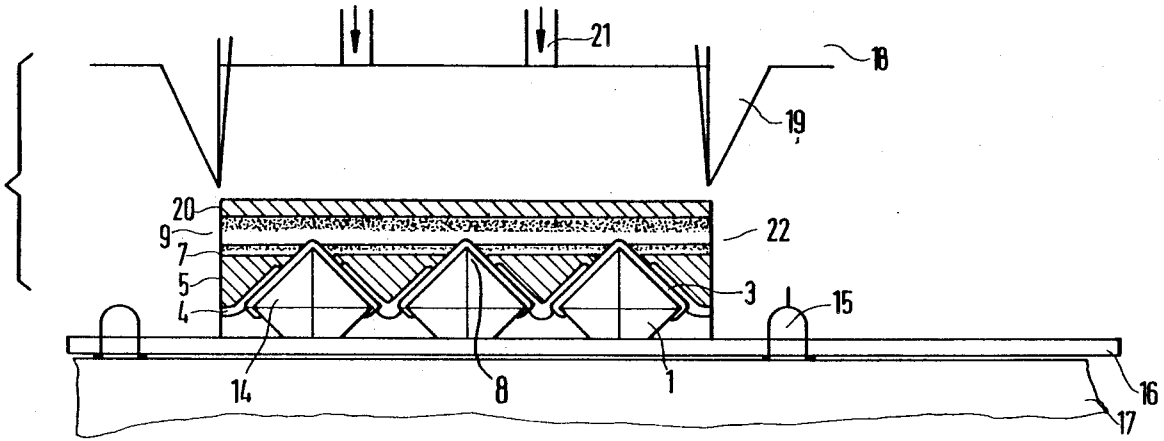
FIG. 2 shows a schematic view of a gem compound after pressing in a pressing tool.

FIG. 2 shows finished gem compound 22 on transfer sheet 16. The gem compound was cut off by means of cutting knives 19 which, however, did not cut through transfer sheet 16 but were led to a stop. In this way, a number of gem compounds can be disposed on one transfer sheet for further use. Compressed air supply means 21 serve to eject gem compound 22 out of pressing head 18.

FIG. 3 shows in a similar way to FIG. 1 the production of a gem compound, gems 1 here being interconnected and held via a continuous melt adhesive layer 3. Melt adhesive layer 3 covers mounting portion 14 of gems 1. The gems are seated on pressing table 17 which also bears cutting knives 19.

The layers are pressed in the form of a compound sheet 24 onto gems 1 by means of pressing head 18.

Figure 4:
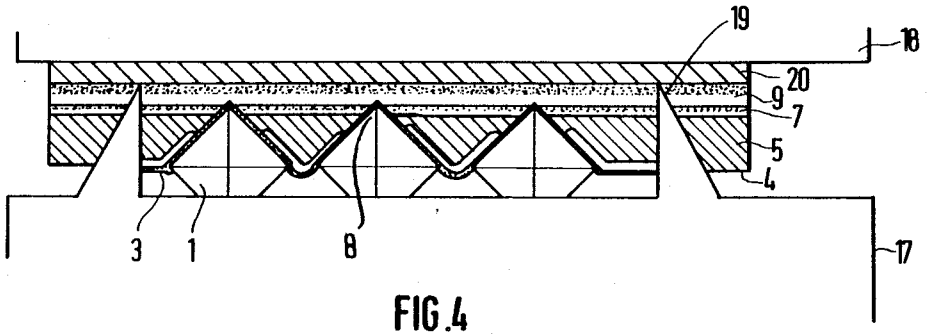
FIG. 4 shows a schematic view of a gem compound after pressing in a pressing tool.
Figure 5:
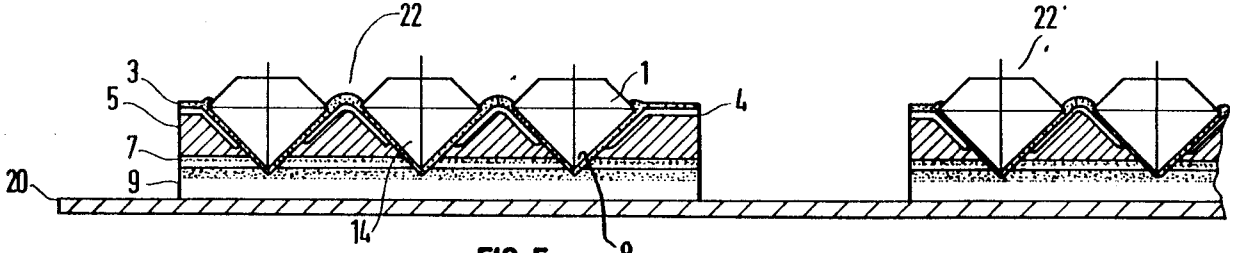
FIG. 5 shows a schematic view of a gem compound.

The finished gem compound is shown in FIG. 4, which again indicates that cutting knives 19 do not cut through cover layer 20, so that a plurality of gem compounds can remain on a sheet, as shown in FIG. 5, where a gem compound 22 shown in its entirety and a gem compound 22' shown only in part are disposed on a common cover layer 20.

Figure 6:
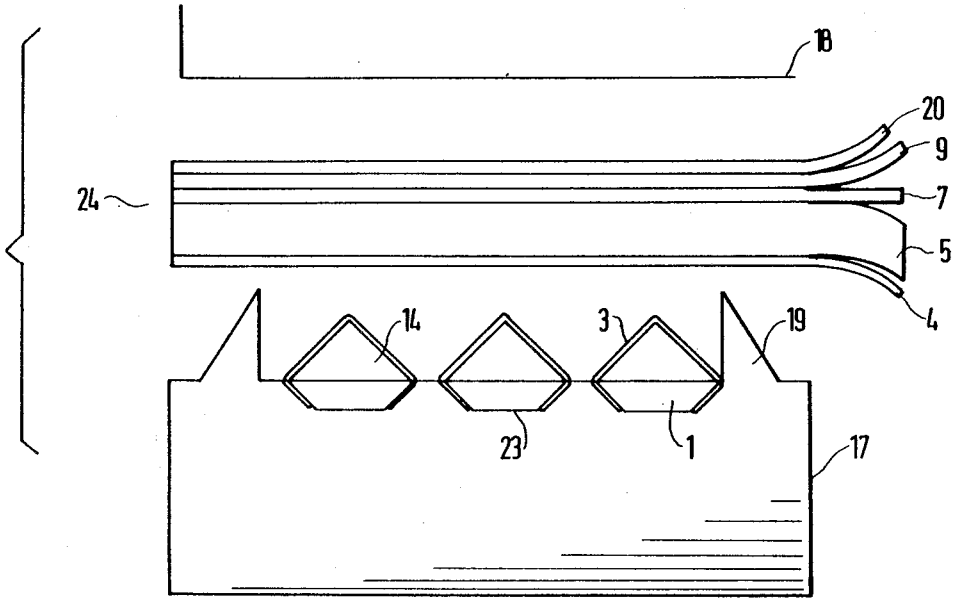
FIG. 6 shows a schematic view of gems and a compound sheet in a pressing before being pressed into a gem compound.

FIG. 6 shows an embodiment in which gems 1 are disposed in recesses 23 in a pressing table 17 formed as a swage block. This table also bears cutting knives 19. Compound sheet 24 is pressed onto gems 1 provided with melt adhesive layer 3 by means of pressing head 18 which is also formed as a sonotrode for ultrasonics.

Figure 7:
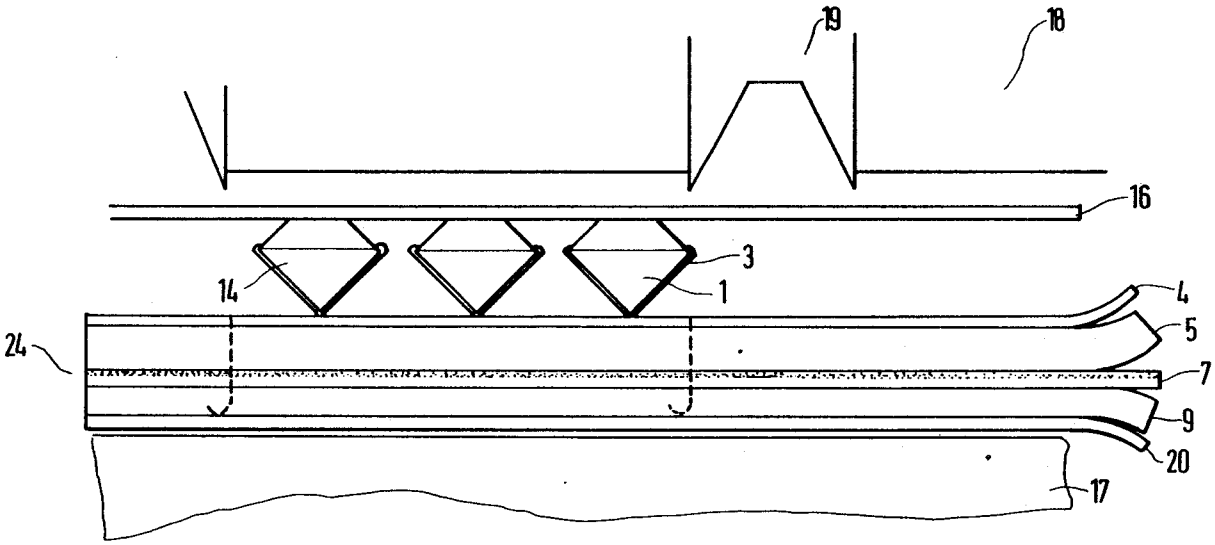
FIG. 7 a schematic view of gems and a compound sheet in a pressing tool before being pressed into a gem compound.

FIG. 7 shows an embodiment in which compound sheet 24 is placed on a pressing table 17. Gems 1 provided with melt adhesive layer 3 are placed thereabove in the desired arrangement on a transfer sheet 16. Pressing is then performed by means of pressing head 18 with cutting knives 19 and the sheets pressed with the gems are cut off with knives 19 as far as cover layer 20.

The inventive gem compound is suitable for a great variety of purposes, such as application to textiles, leather or for costume jewelry.

The gem compound is particularly suitable for producing jewelry in the embodiment having intermediate layer 9 with a self-adhesive coating with such embodiments one need only remove cover layer 20 and insert the gem compound at a suitable place on the jewelry, in particular in specially provided depressions, where it adheres sufficiently by means of the self-adhesive layer provided on intermediate layer 9.

Gem compounds of this design are flat but also bendable, i.e. to be adapted, for example, to cylindrical surfaces.

Since self-adhesive layers do not require heating, heat-sensitive materials such as plastic or spun type castings can be provided in a simple manner with the inventive gem compounds.

I claim:

1. A gem-containing article comprising a plurality of spaced gems having setting surfaces, in cluding end tips comprising portions of the setting surfaces of said gems; a first melt adhesive layer supported on said setting surfaces; a filling layer disposed over portions of said first melt adhesive layer for filling the spaces between said gems; a second melt adhesive layer disposed over said filling layer and adhesively joined to portions of said first adhesive layer at the tips of said gems; said second melt adhesive layer being substantially flat for effecting adhesion of said article to a supporting substrate in surface-to-surface engagement.

2. The article of claim 1 wherein an effect layer is disposed between the first melt adhesive layer and the filling layer.

3. The article of claim 1 or 2 wherein a substantially uniform, self-adhesive layer is disposed on the second melt adhesive layer.

4. The article of claim 1 or 2 wherein the gems are cut glass gems.

5. The article of claim 1 or 2 wherein the first melt adhesive layer is discontinuous.

6. The article of claim 1 or 2 wherein the filling layer has self-adhesive layers on both sides thereof.

7. The article of claim 1 or 2 wherein the thickness of the filling layer corresponds approximately to the height of the gem portions defined by said setting surfaces.

* * * * *